US005901852A

United States Patent [19]

Simpson

[11] Patent Number: 5,901,852

[45] Date of Patent: May 11, 1999

[54] INTEGRATED PACKAGING FOR PROTECTING OBJECTS

[76] Inventor: Eugene D. Simpson, Palo Alto, Calif.

[21] Appl. No.: 09/073,922

[22] Filed: May 6, 1998

[51] Int. Cl.[6] ..... B65D 81/07

[52] U.S. Cl. ..... 206/583; 206/594

[58] Field of Search ..... 206/583, 588–592, 206/594, 495, 784, 806; 229/104, 115

[56] References Cited

U.S. PATENT DOCUMENTS

| | | | |
|---|---|---|---|
| 43,974 | 8/1864 | Converse . | |
| 539,554 | 5/1895 | Smith . | |
| 758,138 | 4/1904 | Hinde . | |
| 804,151 | 11/1905 | Miner . | |
| 1,021,998 | 4/1912 | Myers . | |
| 1,123,884 | 1/1915 | Jones et al. . | |
| 1,124,438 | 1/1915 | Holton . | |
| 1,185,709 | 6/1916 | Penn . | |
| 1,352,759 | 9/1920 | Markert . | |
| 1,367,174 | 2/1921 | Botnen . | |
| 1,877,840 | 9/1932 | Frowenfeld . | |
| 2,030,996 | 2/1936 | Lustig . | |
| 2,448,401 | 8/1948 | Stone . | |
| 2,535,229 | 12/1950 | Paolantonio . | |
| 2,645,340 | 7/1953 | Dow . | |
| 2,646,165 | 7/1953 | Whitehead . | |
| 2,700,518 | 1/1955 | Ryno et al. . | |
| 2,771,184 | 11/1956 | Ryno et al. . | |
| 3,355,011 | 11/1967 | Cilluffo . | |
| 3,752,301 | 8/1973 | Bluemel . | |
| 3,780,854 | 12/1973 | Ruppenthal . | |
| 3,780,933 | 12/1973 | Freeman . | |
| 3,811,565 | 5/1974 | Tancredi . | |
| 3,885,667 | 5/1975 | Spiegel et al. . | |
| 3,885,671 | 5/1975 | Spiegel et al. . | |
| 4,191,289 | 3/1980 | Austin . | |
| 4,523,702 | 6/1985 | Viio . | |
| 4,852,743 | 8/1989 | Ridgeway . | |
| 4,981,213 | 1/1991 | Dillon . | |
| 5,056,665 | 10/1991 | Boecker et al. . | |
| 5,121,838 | 6/1992 | Dickie . | |
| 5,226,542 | 7/1993 | Boecker et al. . | |
| 5,325,967 | 7/1994 | Gonzales . | |
| 5,425,499 | 6/1995 | Pfieffer . | |
| 5,669,506 | 9/1997 | Lofgren et al. | 206/583 |
| 5,678,695 | 10/1997 | Ridgeway et al. | 206/583 |
| 5,722,541 | 3/1998 | Lofgren et al. | 206/583 |
| 5,738,218 | 4/1998 | Gonzales . | |

FOREIGN PATENT DOCUMENTS 377948 1/1931 United Kingdom .

OTHER PUBLICATIONS

Cradelair® Suspension Packs, ADE, Inc. Advertising Brochure.

*Primary Examiner*—Paul T. Sewell
*Assistant Examiner*—Luan K. Bui
*Attorney, Agent, or Firm*—Morrison & Foerster LLP

[57] ABSTRACT

An integrated packaging for protecting an object is disclosed. The packaging is foldable preferably from a single sheet to form a container having a plurality of side walls. The packaging also comprises two suspension platforms at opposing open ends of the container, each with at least one foldable spacer at an edge thereof. The spacers spaces each platform from a corresponding end of the container by a predetermined distance. The object is held within a flexible member which is suspended between the suspension platforms. Although the disclosed container may have open ends, it desirably has covers foldable from the single sheet to enclose the packaging.

12 Claims, 6 Drawing Sheets

INTEGRATED PACKAGING FOR PROTECTING OBJECTS

FIELD OF THE INVENTION

The present invention is an integrated packaging for protecting an object, especially during shipping. More particularly, the present invention is an integrated packaging which provides suspension platforms for suspending the object inserted into a flexible member therebetween.

BACKGROUND OF THE INVENTION

Packaging of small articles for shipping often relies on the use of a simple rectangular box filled with various types of filler materials such as well known Styrofoam "peanuts," popcorn, foam rubber, expanded starch packing material, etc. However, these packing materials are inconvenient and/or undesirable in that they create debris which preferably is recycled but often is not. Storage of the packing material prior to use also consumes storage space. Further, despite the relatively small weight of most of the noted packing materials, these packing materials nonetheless increases the shipping costs as most shipping costs are based on weight.

A number of patents describe containers which maintain the object to be protected away from the walls of the container during shipping. For example, U.S. Pat. No. 2,771,184 to Ryno et al. shows a cylindrical package in which the object to be protected is placed between the two ends of a cylinder by a twisted plastic tube. The plastic tube is twisted tied above and below the article and held in tension in the center of the tube during shipping.

U.S. Pat. No. 3,752,301 to Bluemel shows a shock-proof packing container having a rectagonal outer carton and a polygonal inner support member. The polygonal support member is configured in such a way that it fits snugly inside the outer carton and in turn supports a flexible sling. The objects to be protected are wrapped in the sling and suspended in the interior both of polygonal inner member and the rectangular outer box.

U.S. Pat. No. 5,325,967 to Gonzales shows a packaging device also formed of an outside container and having a removable inner platform which, via the use of folded and integrated spacers, causes the object to be protected to be spaced apart from the walls of the container. The object to be shipped is held against the inner platform by, for instance, a plastic bag which envelops the object and that bag passes through an orifice within the support platform and is attached in some fashion to the edge of that platform. This patent further discusses other variations of protective packaging found in the prior art at column one.

None of the devices shown or described in any of these references shows the structure and features of the integrated packaging of the present invention.

SUMMARY OF THE INVENTION

The present invention is a foldable protective packaging for protecting objects, particularly during shipping. It preferably is of a paper cardboard, e.g., corrugate, although it may be of any suitable flat material such as paper bonded Styrofoam board or polyolefin flat stock materials simulating paper corrugate or the like. The inventive packaging is provided with a flexible member, such as a plastic bag, into which the object is placed and two integral components: three or more protective exterior side walls forming the outer surface of the overall package and two suspension platforms located at opposing ends of the exterior side walls for suspending the object placed within the flexible member therebetween.

In one preferred embodiment of the present invention, the side walls and the suspension platforms are situated on a single blank sheet in such a way that the container may be merely folded into the packaging. A square or rectangular cross-section is the preferred although a triangular cross-section may also be utilized.

The packaging is provided with a flexible member, such as a plastic bag or a polymeric sheet, into which the object to be protected is placed for suspension between the two suspension platforms. The flexible member may be of any suitable material for suspending the object placed therein between the two suspension platforms. The flexible member is typically polymeric in nature and preferably is elastomeric, such as a plastic bag or a polymeric sheet. The flexible member may be secured to one of the suspension platforms by adhesive, staples, tape, and/or any other suitable mechanism for securing the flexible member.

Each suspension platform is preferably formed by overlapping two platform panels extending from two adjacent side walls of the packaging. Each of the panels preferably includes a spacer at an edge thereof. The spacers allow the suspension platforms to be separated from the ends of the packaging. The spacers also ensure that the object placed within the flexible member is suspended at a distance away from the ends of the packaging by the suspension platforms. Thus, the inventive packaging is constructed in such a way that filler protective material is not needed.

Each suspension platform preferably secures a corresponding end portion of the flexible member thereto to prevent or minimize displacement of the object within the packaging. Each platform panel preferably includes a slot or orifice through which a corresponding end portion of the flexible member is inserted. The slots or orifices of the panels corresponding to a suspension platform are configured such that they overlap when the panels are overlapped to form a single opening. Thus, the end portion inserted through the single opening can then be secured by friction between a platform panel and an elongate panel and/or by an adhesive, tape, staples and/or other suitable mechanisms.

Although the inventive packaging may have one or two open ends, it desirably has closure panels for enclosing the packaging. The closure panels are preferably foldable from same single blank sheet. The closure panels may be secured to the side walls of the packaging by adhesive, tape, staples, attachment flaps and/or any other suitable mechanism for securing the closure panels. Alternatively, the closure panels may be independent components which are plugged into or capped onto the open ends.

DESCRIPTION OF THE INVENTION

The present invention comprises an integrated packaging for protecting objects, particularly during shipping. The following description is presented to enable any person skilled in the art to make and use the invention. Descriptions of specific applications are provided only as examples. Various modifications to the preferred embodiment will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

Figure 1:
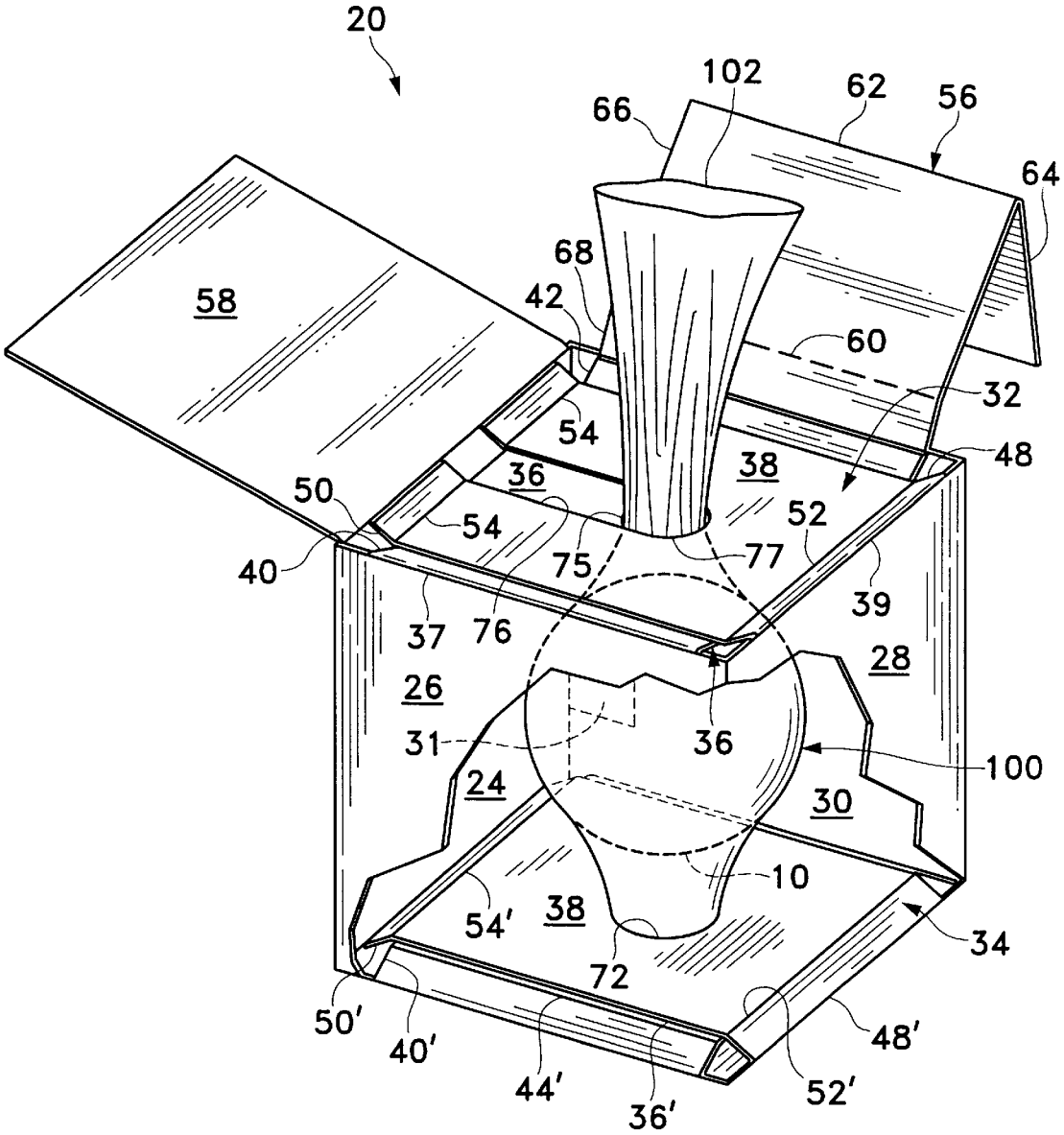
FIG. 1 shows a partially cut-away perspective view of a currently preferred embodiment of the assembled integrated packaging containing the object to be protected.
Figure 2A:
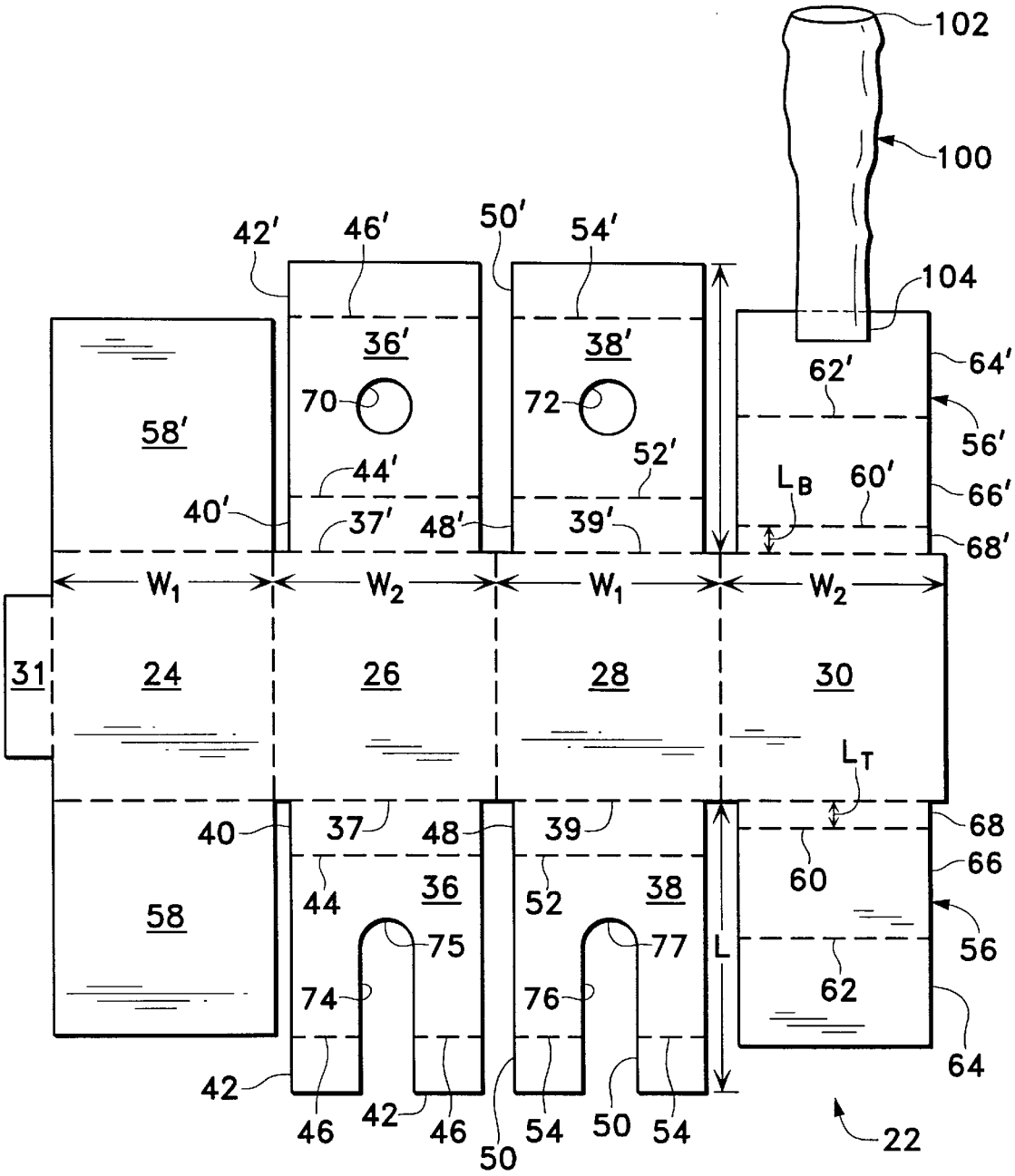
FIG. 2A shows a plan view of the single unfolded sheet for forming the packaging of FIG. 1 without showing the object to be protected.

FIG. 1 illustrates a partially cut-away perspective view of the currently preferred embodiment of packaging 20 of the present invention containing the object 10 to be protected . FIG. 2A contains a plan view of the single unfolded sheet 22 from which the packaging of FIG. 1 may be formed.

The material for sheet 22 making up the packaging 20 devices may be any appropriate, and preferably recyclable, sheet stock. Most corrugate is made from kraft paper or other similar paper stock. Of course, depending on the service into which the packaging is placed, other materials may be selected, e.g., polyethylene terephthalate (Mylar), polyethylene sheet, polypropylene (clear or fibrous paper product), or the like are acceptable. The sheet stock may be corrugate or may, of course, have a honeycomb core. The way in which the edges are creased and then sealed are obviously dependent upon the material from which the packaging is made. For instance, a corrugate or honeycomb flat stock may be simply creased or partially scored. Thermoplastic polymeric materials such as fibrous polypropylene or Mylar may be provided with seams by the use of heat.

As shown in FIGS. 1 and 2, packaging 20 comprises exterior side walls 24, 26, 28, 30 and top and bottom suspension platforms 32, 34 formed at the top and bottom open ends, respectively, of the space formed by side walls 24, 26, 28, 30. Suspension platforms 32, 34 are designated as top and bottom only for convenience of description. As will be understood, suspension platforms 32, 34 may be in any suitable orientation relative to the packaging 20.

Packaging 20 may comprise three or more of side walls, although the currently preferred comprises four side walls. Packaging 20 may include a side wall attachment flap 31 extending from a free edge of side wall 24 to be secured along at least a portion of the free edge of side wall 30 such that side walls 24, 26, 28, 30 form a container with a volume of space therein. The application of an adhesive on flap 31 to attach flap 31 along the free edge of side wall 30 is preferred although there are numerous other ways of joining the edges of side walls 24 and 30 to form a container with a volume of space therein, such as by tape, staples, and/or any other suitable mechanism.

The top suspension platform 32 is formed of two overlapping platform panels 36, 38 extending from side walls 26, 28, and foldable relative to the side walls 26, 28 along seams 37, 39, respectively. Spacers 40, 42 may be formed from panel 36 by folding along seams 44, 46, respectively, so as to position the central portion of panel 36 a predetermined distance away from the edges of side walls 24, 26, 28, 30 and into the space formed by the side walls. Similarly, spacers 48, 50 may be formed from panel 38 by folding along seams 52, 54, respectively, so as to position the remainder of panel 38 a predetermined distance away from the edges of side walls 24, 26, 28, 30 and into the space formed by the side walls.

Packaging preferably further comprises an internal top panel 56 and a top cover 58. Top cover 58 is configured to enclose the open top end of the space formed by side walls 24, 26, 28, 30. Top cover 58 can be secured to a portion of the remainder of the packaging 20, such as side wall 28.

Internal top panel 56 cooperates with the top cover 58 and the top suspension platform 32 to provide for the absorption of shocks and/or other motions or disturbances to packaging 20 to further protect the object 10 placed therein. Internal top panel 56 is preferably foldable along seams 60, 62 to form overlapping portions 64, 66 and a spacer portion 68. Spacer portion 68 allows portion 66 to be spaced a distance away from the edges of side walls 24, 26, 28, 30 and into the space between the top suspension platform 32 and top cover 58. Thus, when top cover 58 is secured to side wall 28, top cover 58 urges the overlapping portions 64, 66 against top suspension panels 36, 38. In other words, the double-thickness of the overlapping portions 64, 66 ensures that top suspension platform 32 remains spaced a distance away from top cover 58. Further, overlapping portions 64, 66 also serves to absorb shocks and/or other motions or disturbances to packaging 20 to further protect the object 10 placed therein.

The bottom suspension platform 34 comprises similar components as top suspension platform 32 and are indicated with the same reference numerals as those of the top suspension platform 32 with a prime ('). For example, bottom suspension platform 34 is formed of two overlapping platform panels 36', 38' extending from side walls 26, 28, and foldable relative to the side walls 26, 28 along seams 37', 39', respectively. Spacers 40', 42' may be formed from panel 36' by folding along seams 44', 46', respectively, so as to position the central portion of panel 36' a predetermined distance away from the edges of side walls 24, 26, 28, 30 and into the space formed by the side walls. Similarly, spacers 48', 50' may be formed from panel 38' by folding along seams 52', 54', respectively, so as to position the remainder of panel 38' a predetermined distance away from the edges of side walls 24, 26 28, 30 and into the space formed by the side walls.

Packaging preferably further comprises an internal bottom panel 56' and a bottom cover 58'. Bottom cover 58' is configured to enclose the open bottom end of the space formed by side walls 24, 26, 28, 30. Bottom cover 58' can be secured to a portion of the remainder of the packaging 20, such as side wall 28.

Internal bottom panel 56' cooperates with the bottom cover 58 and the bottom suspension platform 34 to provide for the absorption of shocks and/or other motions or disturbances to packaging 20 to further protect the object 10 placed therein. Internal bottom panel 56' is preferably foldable along seams 60', 62' to form overlapping portions 64', 66' and a spacer portion 68'. Spacer portion 68' allows portion 66' to be spaced a distance away from the edges of side walls 24, 26, 28, 30 and into the space between the bottom suspension platform 32' and bottom cover 58'. Thus, when bottom cover 58' is secured to side wall 28, bottom cover 58' urges the overlapping portions 64', 66' against bottom suspension panels 36', 38'. In other words, the double-thickness of the overlapping portions 64', 66' ensures that bottom suspension platform 34 remains spaced a distance away from bottom cover 58'. Further, overlapping portions 64', 66' also serves to absorb shocks and/or other motions or disturbances to packaging 20 to further protect the object 10 placed therein.

The packaging 20 is preferably utilized in conjunction with a flexible member 100 for holding object 10 such that the object 10 can be suspended between suspension platforms 32, 34. Flexible member 100 has an open end 102 through which the object 10 to be protected can be inserted and a bottom end portion 104. The bottom end portion 104 is preferably secured to portion 64' of internal bottom panel 56', for example, by staples, clips, adhesive, tape, and/or any other suitable mechanism. Alternatively, portion 64' may provide an opening (not shown) such that bottom end portion 104 may be wrapped around the opening. The portion 64' may be secured to portion 64' by the force of friction between the bottom end portion 104 and other portions of the packaging 20 with which bottom end portion 104 is contact and/or by staples, adhesive, tape, clips and/or any other suitable mechanism.

Flexible member 100 is preferably positioned through orifices 70, 72 provided in bottom suspension panels 36', 38', respectively. Orifices 70, 72 are configured and positioned relative to the suspension panels 36', 38' such that upon overlapping bottom suspension panels 36', 38', orifices 70, 72 are also overlapped and aligned relative to each other to form a single opening through which flexible member 100 is positioned.

The flexible member 100 may be of any suitable material for suspending the object placed therein between the two suspension platforms 32, 34. For example, the flexible member 100 may be typically polymeric in nature and preferably is elastomeric, such as a plastic bag or a polymeric sheet.

Similarly, flexible member 100 is also preferably positioned through both of slots 74, 76 provided in top suspension panels 36, 38, respectively. Although the slots 74, 76 as shown are preferred, any suitable slot or opening extending inwardly from an edge of the suspension panel may be utilized. Slots 74, 76 are configured and positioned relative to the suspension panels 36, 38 such that upon overlapping top suspension panels 36, 38, slots 74, 76 arc generally perpendicular to each other and partially overlapped to form a singular opening through which flexible member 100 is positioned. Each of slots 74, 76 preferably has a rounded or U-shaped end 75, 77 such that when slots 74, 76 are overlapped, U-shaped ends 75, 77 form a single generally circular opening. Thus, by positioning flexible member 100 through both slots 74, 76, a portion of flexible member 100 is confined within the single opening.

Figure 2B:
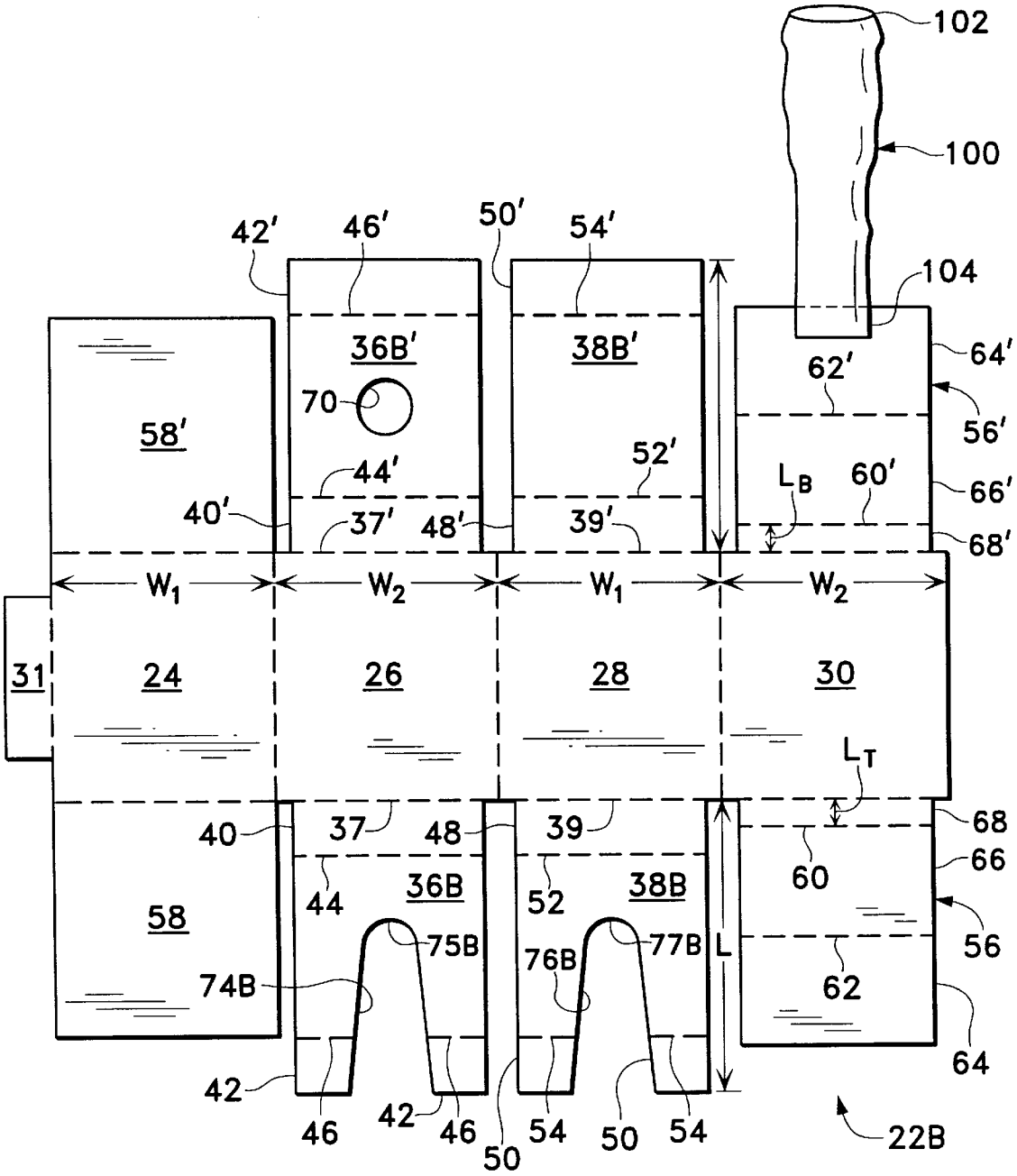
FIG. 2B shows a plan view of a single unfolded sheet for forming an alternative embodiment of the packaging without showing the object to be protected.

Several alterations made be made to the preferred embodiment of the packaging 20 as disclosed above. An example of an alternative embodiment is shown in FIG. 2B which shows a single unfolded sheet 22B for forming an alternative embodiment of the packaging (not shown). As shown in FIG. 2B, only one of suspension panels 36B', 38B' defines an orifice 74. Of course, suspension panel 38B' need not be provided at all, although both panels 36B', 38B' are preferred to provide additional strength to the packaging.

In addition, slots 74B, 76B are tapered such that it decreases in size from the edge of the panels 36B, 38B to the rounded ends 75B, 77B. Such tapering of 74B, 76B further increases the ease of inserting flexible member 100 therein (as will be described in more detail below). The precise amount of tapering as well as the size of the openings of slots 74B, 76B at the edge of the panels 36B, 38B may be dependent upon the structural characteristics of the material forming panels 36B, 38B and/or the size and weight of the object 10 to be protected.

Other alternative embodiment includes replacing one or both of orifices 70, 72 in suspension panels 36', 38' with one or two slots (not shown) similar to the slots 74, 76 provided in suspension panels 36, 38. Another alternative embodiment includes replacing one or both of slots 74, 76 in suspension panels 36, 38 with one or two orifices (not shown) similar to the orifices 70, 72 provided in suspension panels 36', 38'. As is evident, any suitable combinations of slots and/or orifices may be provided in suspension panels, 36, 38, 36', 38'.

In addition, although suspension panels 36, 38 and suspension panels 36', 38' are shown and described to be extending from adjacent side walls 26, 28, suspension panels 36, 38 and/or suspension panels 36', 38' may extend from alternate side walls, such as side walls 24, 28.

Further, one or both of internal panels 56, 56' may be eliminated. Such elimination of internal panels 56, 56' may be dependent upon factors such as the weight and size of the object 10 to be protected, the amount of space desired between the suspension platforms 32, 34 and covers 58, 58', and/or the dimensions of the packaging.

Although the inventive packaging 20 preferably has closed ends, the packaging may have one or two open ends. Alternatively, one or both of top and bottom covers 58, 58' panels may be independent components which are plugged into or capped onto the open ends.

Forming the Packaging

In the preferred embodiment of the present invention, the side walls 24, 26, 28, 30 and the suspension platforms 32, 34 are situated on a single blank sheet 22 in such a way that the sheet 22 may be merely folded into the packaging 20 and secured. A square or rectangular cross-section is preferred although a triangular cross-section may also be utilized.

To form the packaging 20 from the sheet 22, adhesive may be applied to a surface of side wall attachment flap 31 and secured along at least a portion of an edge of side wall 30 such that side walls 24, 26, 28, 30 form a space therein. The application of an adhesive on flap 31 to attach flap 31 along the free edge of side wall 30 is preferred although numerous other methods of joining the edges of side walls 24 and 30 to form the space, such as by tape, staples, and/or any other suitable mechanism are readily apparent.

Figure 3:
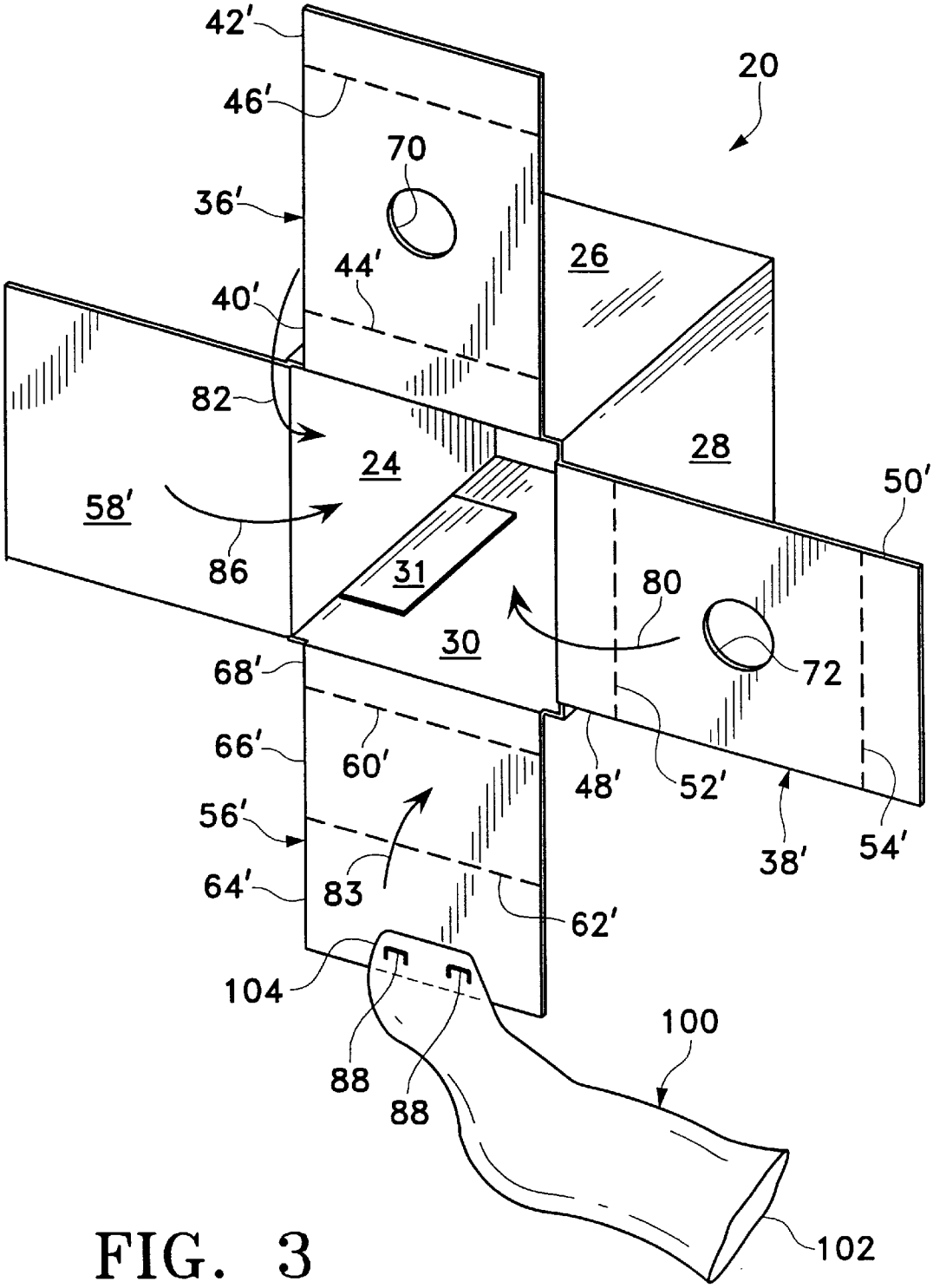
FIG. 3 shows a perspective view of the partially assembled packaging of FIG. 1 illustrating the unassembled bottom suspension platform having a flexible member attached thereto.

As shown in the perspective view of the partially assembled packaging of FIG. 3, once side wall 24 is secured to side wall 30, bottom suspension platform 34 may be formed by folding the bottom suspension panels 36' and 38' into the space formed by the side walls, as indicated by arrows 80, 82 and in an overlapping manner. Bottom suspension platform 34 is spaced a distance from the bottom end of packaging 20 by folding along seams 44', 46', 52', 54' to form spacers 40', 42', 48', 50', respectively, away from the edges of the side walls 24, 26, 28 30.

The bottom end portion 104 of flexible member 100 may be attached to portion 64' of internal bottom panel 56' by means of staples 88. Of course, flexible member 100 may be attached to portion 64' prior to securing side walls 24 and 30 or prior to forming the bottom suspension platform 34. The open end 102 of flexible member 100 is then inserted through orifices 70, 72. Preferably, member 100 is pulled at least partially through orifices 70, 72.

Portion 64' of internal bottom panel 56' may be overlapped with portion 66', as indicated by arrow 83. The resulting bottom suspension platform 34 is shown in FIG. 4, although flexible member 100 is not shown for purposes of clarity.

Figure 4:
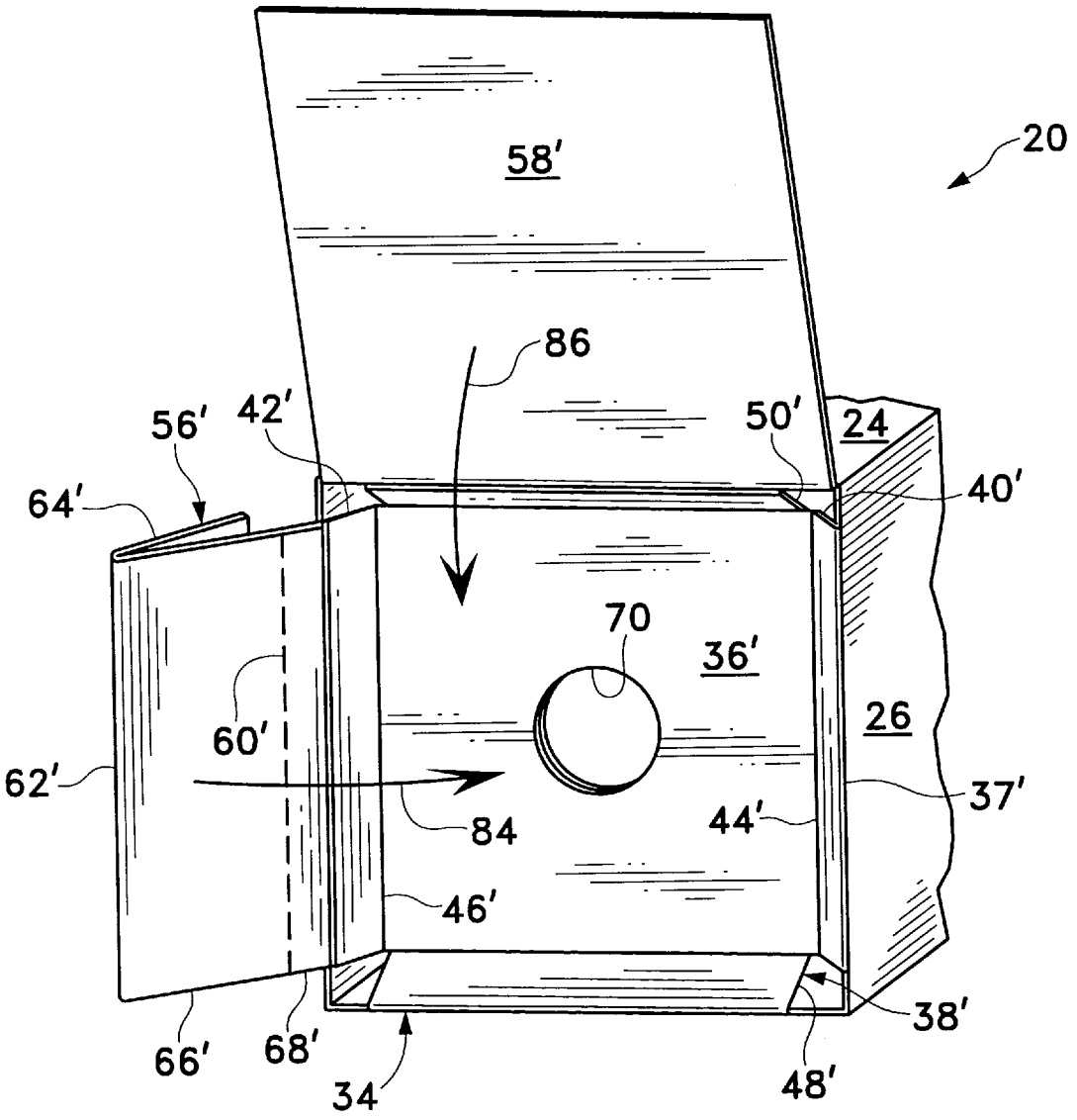
FIG. 4 shows a perspective view of the assembled bottom suspension platform of FIG. 3 without a flexible member attached thereto.

Referring now to FIG. 4, overlapped portions 64', 66' may then be folded into the bottom of packaging 20 as indicated by arrow 84. Member 100 may then be pulled through orifices 70, 72 until bottom end portion 104 is pulled relatively taut. Bottom cover 58' may then be folded toward internal bottom panel 56' as indicated by arrow 86 and secured to side wall 28 by means of tape or any other suitable mechanism. Bottom cover 58' thus encloses bottom suspension platform 34 and internal bottom panel 56' within the packaging 20.

At this point, the packaging 20 may placed right-side-up and the object 10 to be protected may be placed into the flexible member 100 through its open end 102.

Figure 5A:
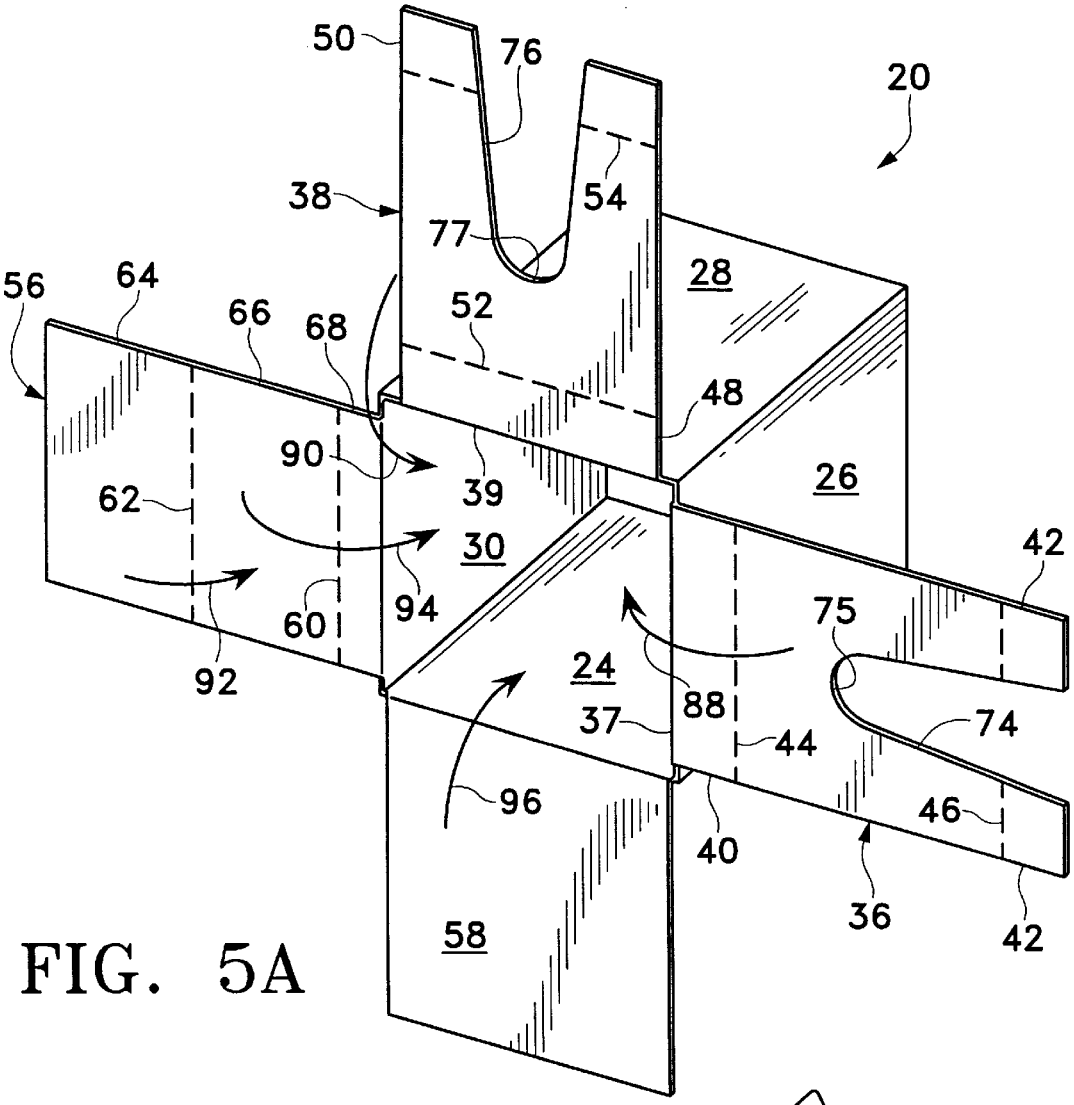
FIG. 5A shows a perspective view of the partially assembled packaging of FIG. 1 illustrating the unassembled top suspension platform having a flexible member attached thereto.

Referring now to the perspective view of the unassembled top suspension platform of FIG. 5A, the top suspension platform 32 may be formed in a similar manner. While holding the open end 102 of flexible member 100 above the open top end of the packaging 20, top suspension platform 32 may be formed by folding the top suspension panel 36 into the space formed by the side walls, as indicated by arrow 88 while inserting a portion of flexible member 100 through slot 74 such that the corresponding portion of flexible member 100 is rested against the rounded end 75. Top suspension panel 36 is spaced a distance from the top end of packaging 20 by folding along seams 44, 46 to form spacers 40, 42, respectively, away from the edges of the side walls 24, 26, 28 30.

Similarly, while holding the open end 102 of flexible member 100 above slot 74, top suspension platform 32 may be completed by folding the top suspension panel 38 onto panel 36 as indicated by arrow 90 while inserting a portion of flexible member 100 through slot 76 such that the corresponding portion of flexible member 100 is rested against the rounded end 77. The flexible member 100 is then preferably pulled taut at its open end 102 through the single opening formed by the rounded ends 75, 77. Top suspension panel 38 is spaced a distance from the top end of packaging 20 by folding along seams 52, 54 to form spacers 48, 50, respectively, away from the edges of the side walls 24, 26, 28 30.

Internal top panel 56 may now be folded into packaging 20 by first overlapping portion 64 with portion 66, as indicated by arrow 92. Overlapped portions 64, 66 are then folded into the top of packaging 20 as indicated by arrow 94. At this point, flexible member 100 may be attached to a portion of the packaging 20 such as portion 64. Alternatively, the portion of flexible member 100 extending through the opening formed by overlapping slots 74, 76, may simply be disposed between suspension platform 32 and internal top panel 56 and retained in place by frictional forces.

Top cover 58 may then be folded toward internal top panel 56 as indicated by arrow 96 and secured to side wall 28 by means of tape or any other suitable mechanism. Top cover 58 thus encloses top suspension platform 32 and internal top panel 56 within the packaging 20.

Figure 5B:
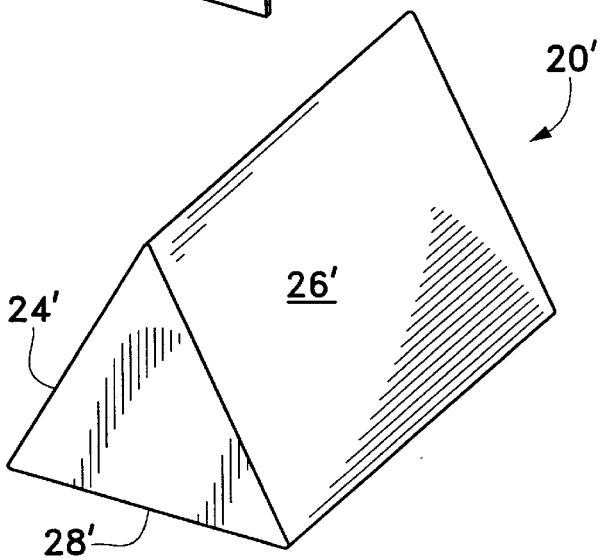
FIG. 5B shows a perspective view of an assembled packaging having three side walls.

FIG. 5B shows a perspective view of an assembled packaging 20' having three side walls 24', 26', and 28'.

As is evident, slots 74, 76 of suspension panels 36, 38 provides the advantage of ease of packaging the object 10 to be protected within packaging 20. For example, by providing a packaging 20 assembled except for the top portion including the top suspension platform 32, an operator only needs to perform four simple steps of secure the object within the packaging 20: (1) place the object 10 into the flexible member 100, (2) fold the top suspension panels 36, 38 into the packaging 20 while holding the open end 102 of member 100 above the packaging 20, (3) fold internal panel 56 into the packaging 20 and (4) secure the top cover 58 onto the side wall 28.

Further, by providing slots 74, 76 on suspension panels 36, 38 and orifices 70, 72 on suspension panels 36', 38', a second separate component is not needed for the packaging 20. The elimination of such a need not only reduces the number of pieces of and thus reduces the complexity of the packaging 20 but also reduces the number of steps necessary to form and secure the packaging 20. Thus, the packaging 20 of the present invention allow for faster and easier assembly and secure of packaging 20.

Referring back to FIG. 2A, each of suspension panels 36, 38, 36', 38' preferably has a width which is slighter smaller than the width of the side wall from which the respective suspension panel extends in order to facilitate assembly of packaging 20. For example, suspension panels 36, 36' preferably has a width which is slighter smaller than the width $w_2$ of side wall 26 and suspension panels 38, 38' preferably has a width which is slighter smaller than the width $w_1$ of side wall 28. To further facilitate assembly of packaging 20, internal panels 56, 56' also preferably has a width which is slighter smaller than the width $w_2$ of side wall 30 from which panels 56, 56' extends. In contrast, covers 58, 58' preferably has a width the same as the width $w_1$ of side wall 24 to ensure adequate enclosure of packaging 20.

Further, each of suspension panels 36, 38, 36', 38' preferably has a length L which is greater than width of the corresponding side walls which it spans when the packaging 20 is assembled such that suspension platforms 32, 34 may be disposed at a distance from a corresponding end of packaging 20. Preferably, suspension panel 36 has the same length as suspension panel 36' and suspension panel 38 has the same length of suspension panel 38'. For example, suspension panels 38, 38' preferably has a length L which is greater than the width $w_2$ of side walls 26, 30. In addition, although not shown, suspension panels 36, 36' preferably has a length which is greater than the width $w_1$ of side walls 24, 28. Although not shown, when the packaging has a rectangular cross-sectional shape, the lengths of suspension panels 36, 36' would be different from suspension panels 38, 38'.

The length of internal panels 56, 56' may be independent of the dimensions of the packaging 20. For example, each of internal panels 56, 56' may be not folded at all or may be folded multiple times to obtain the desired thickness between the respective suspension platform and the top and bottom ends of the packaging. Thus, However, the length $L_T$ of the spacer portion 68 of internal top panel 56 preferably correspond to or is dependent upon the dimension of the spacers 40, 42, 48, 50 of the top suspension platform 32. Similarly, the length $L_B$ of the spacer portion 68' of internal bottom panel 56' preferably correspond to or is dependent upon the dimension of the spacers 40', 42', 48', 50' of the top suspension platform 34.

While specific embodiments of the invention have been described and illustrated, it will be appreciated that modifications can be made to these embodiments without departing from the spirit of the invention. Thus, the invention is intended to be defined in terms of the following claims.

I claim as my invention:

1. An integrated packaging for protecting an object, comprising:

a.) a foldable sheet for forming a container, comprising i.) a plurality of side walls which upon folding form said container having an inner space and a first and a second ends, ii.) a first suspension platform having two first suspension panels, each of said first panels foldably extending from one of said side walls along said first end, each of said first panels having edges, each of said first panels defining an opening extending inwardly from one of said edges of each of said first panels such that upon the folding of said first panels to form the packaging, said first openings at least partially overlap to form a single aperture;

iii.) a second suspension platform having a second suspension panel foldably extending from one of said side walls along said second end, said second panel having edges, said panel defining a second opening therethrough, and b.) a flexible member for positioning the object therein and adapted to be positioned through said first opening and through said second opening such that the flexible member is suspended between said first and second suspension platforms.

2. The integrated packaging of claim 1 wherein said first suspension platform further includes at least one foldable first spacer at one of said edges.

3. The integrated packaging of claim 2 wherein each of said first suspension panels includes two foldable first spacers at two of said edges, one of said first spacers being foldable along one of said side walls.

4. The integrated packaging of claim 1 wherein said second suspension platform further includes at least one foldable second spacer at one of said edges.

5. The integrated packaging of claim 1 wherein said second suspension platform includes two second suspension panels, each of said second panels foldably extending from one of said side walls along said second end, each of said second panels having edges, each of said second panels defining a second opening extending inwardly from one of said edges of each of said second panels such that upon the folding of said second panels to form the packaging, said second openings at least partially overlap to form a single aperture.

6. The integrated packaging of claim 5, wherein said second openings extending from said edge of said second suspension panels are slots and wherein upon folding of said second suspension panels to form the packaging, said slots are generally perpendicularly disposed relative to each other.

7. The integrated packaging of claim 1 wherein said first suspension panels extend from two adjacent side walls along said first end.

8. The integrated packaging of claim 1 wherein said first openings extending from said edge of said first suspension panels are slots and wherein upon folding of said first suspension panels to form the packaging, said slots are generally perpendicularly disposed relative to each other.

9. The integrated packaging of claim 8 wherein said slots have rounded ends such that the single first opening formed upon the folding of said first panels to form the packaging generally circular.

10. The integrated packaging of claim 1 further comprising a first cover for enclosing the first end of the container and a first internal panel foldably extending from one of said side walls along said first end, said first internal panel being adapted to be enclosed between said first cover and said first suspension platform.

11. The integrated packaging of claim 10 further comprising a second cover for enclosing the second end of the container and a second internal panel foldably extending from one of said side walls along said second end, said second internal panel being adapted to be enclosed between said second cover and said second suspension platform.

12. The integrated packaging of claim 1 comprising exactly three side walls.

* * * * *